US005935482A

United States Patent [19]

Schwörer

[11] Patent Number: 5,935,482

[45] Date of Patent: Aug. 10, 1999

[54] PLATE TO SUPPORT A CEILING MOULD

[75] Inventor: Artur Schwörer, Senden, Germany

[73] Assignee: Peri GmbH, Weissenhorn, Germany

[21] Appl. No.: 09/064,142

[22] Filed: Apr. 22, 1998

[30] Foreign Application Priority Data

May 16, 1997 [DE] Germany ..... 197 20 728

[51] Int. Cl.[6] ..... E04G 11/48

[52] U.S. Cl. ..... 249/210; 249/219.1; 52/712

[58] Field of Search ..... 248/300; 52/673, 52/675, 712, 715; 249/18, 19, 218, 219.1, 28, 210

[56] References Cited

U.S. PATENT DOCUMENTS 3,785,110 1/1974 Galloway et al. ..... 52/715

FOREIGN PATENT DOCUMENTS 3024580 1/1982 Germany .
4204788 8/1993 Germany .

OTHER PUBLICATIONS

Company brochure "Peri Skydeck", p. 20, Jan. 1995.

*Primary Examiner*—Michael Safavi
*Attorney, Agent, or Firm*—Paul Vincent

[57] ABSTRACT

A plate of a support structure for a ceiling mold for the production of concrete ceilings, in particular seating plates of a support head with holding means disposed on the plate for a ceiling mold element for gap filling members. A first large protrusion and a second large protrusion are provided in only one corner region of a substantially rectangular plate to hold the ceiling mold element. The first and second large protrusions are wider and higher than a plurality of other smaller protrusions disposed on the upper surface of the plate.

14 Claims, 1 Drawing Sheet

PLATE TO SUPPORT A CEILING MOULD

This application claims Paris Convention priority of German patent application No. 197 20 728.6 filed May 16, 1997 the complete disclosure of which is hereby incorporated by reference.

BACKGROUND OF THE INVENTION

The invention concerns a plate of a supporting structure for a ceiling mould for the production of concrete ceilings, in particular on a seating plate of a support head, having holding means disposed on the plate for a ceiling mould element and for gap-filling members.

Conventional plates of this kind as e.g. shown in the Peri brochure "Peri Skydeck" page 20, serve as head plates for a support for the seating of ceiling mould elements. They have, at each of their four corners, two mutually parallel plate-shaped tabs bent up out of the plate. The flat sides of all tabs are parallel to each other. The flat sides of tabs of two neighbouring plate edges lie in a plane.

The four tabs disposed in the region of the corners serve as holding means or stops at which two mutually neighbouring ceiling mould elements can be placed and secured to the plate, wherein gap-filling members for example edge supports or intermediate beams or fitting beams can be placed on surfaces which are not occupied by ceiling mould elements, e.g. two beams extending at a separation from each other onto which a section of a moulding skin can be nailed whose surface dimensions correspond to the size of the gaps. However, gaps are normally present on both sides of the plate in a corner of the ceiling mould which must be filled by gap-filling members provided therefor. Clearly, one attempts to solve all problems occurring in system mould structures, including the filling of residual gaps, using prefabricated members, support beams or fitting beams or the like. For example, at an edge of the ceiling mould, only one ceiling mould element can be placed on the so-called edge plate. On one edge of the ceiling mould element gap-filling members can be placed as previously on a straight section of the wall. In contrast thereto, the tabs formed on other edges of the plate serving as holding means for a ceiling mould element which must accept and secure the second ceiling mould element adjacent to the one ceiling mould element along a straight section of the wall interfere with the introduction of gap-filling members. Therefore, it is not always possible to introduce the required gap-filling members to provide a sufficient seating surface on the edge sections of a corner.

It is the underlying purpose of the invention to develop a plate which can be used as an edge plate which facilitates an improved seating for gap-filling members on the edge plate proximate to a ceiling mould element.

SUMMARY OF THE INVENTION

This purpose is achieved in accordance with the invention in that a first large and a second large protrusion are provided as holding means for the ceiling mould element in only one corner region of a substantially rectangular plate which are wider and higher than a plurality of other smaller protrusions disposed on the surface of the plate.

An advantage of the plate in accordance of the invention is that the large protrusions can hold a ceiling mould element even if the edge of the ceiling mould element seats in a free manner that is to say does not border on a second ceiling mould element with the two mutually adjacent ceiling mould elements supporting each other. The other smaller protrusions on the plate are configured in such a fashion that they hold and secure the gap-filling members such as edge strips and fitting beams towards which end these holding means must not, however, be as strong, wide or high as the holding means for the ceiling mould element which only seats with one corner on the plate. Since the holding means for one corner of the ceiling mould element are only disposed in the edge region of the plate, the gap-filling members can be subsequently disposed on the two edges of the corner of the ceiling mould element without difficulty since, in these regions, there is no need for large and strong holding means for a neighbouring second ceiling mould element. It is therefore possible with the plate in accordance with the invention to place a ceiling mould element on the edge of a ceiling mould in such a fashion that a corner of the mould skin pointing towards the edge of the wall ends approximately in the middle of the plate, wherein the frame legs of the ceiling mould element thereby have a sufficient amount of seating surface on the upper surface of the plate to assure a secure support of the ceiling mould element. In a configuration of this kind with which the corner of the ceiling mould element ends approximately in the middle of the plate, there is a substantial amount of room on both sides of the edges of the ceiling mould element forming the corner which is available for placement of the gap-filling members. A support plate in accordance with the invention has a enlarged seating surface for the gap-filling members while maintaining the outer dimensions of conventional edge plates, since the large protrusions formed on the seating plate are only disposed in one corner region of the seating plate.

In accordance with the invention, the plate is therefore provided with protrusions forming projections disposed asymmetrically on the plate with regard to their differing dimensions (width, height). In one portion (surface section) of the plate, large projections are formed to guarantee secure connection (with respect to rotation and tilting) to a ceiling mould element even under differing loads. In other portions of the surface of the plate, small projections are formed which can fix and hold gap-filling members on the plate on both sides of a corner of the ceiling mould element. In this fashion, the plate in accordance with the invention can be equipped with more gap-filling members than can conventional plates of comparable size. The large projections, preferentially two projections, are solely disposed in one portion of the plate, preferentially in a corner region of the plate.

In an embodiment of the invention, the large projections are disposed in such a fashion that they engage the inner surfaces of the mutually perpendicular frame legs of the ceiling mould element disposed at each corner of the ceiling mould elements, when the ceiling mould element is placed with its corner on the edge of the plate having the large protrusions, these inner surfaces extending perpendicular to the plane of a mould skin of the ceiling mould element. The protrusions can be configured in an arbitrary fashion, e.g. in a form of pins or the like. In one embodiment of the invention these protrusions are plate-like and could be tongues bent up out of the plate material.

It is thereby advantageous if, in one embodiment of the invention, the flat sides of the large plate-like protrusions intersect at right angles so that the protrusions seat on a large area of both frame legs forming the edge of the ceiling mould element. In this manner an unintentional lifting-up of the ceiling mould element from the plate is also prevented when the ceiling mould element is temporarily placed, during assembly of the ceiling mould, on the plate not parallel to the plane of the plate at an angle slanting in the upward or downward direction.

The dimensions and, in particular, the dimensional relationships between the large protrusions and the small ones which substantially only serve to hold the gap-filling members can be arbitrarily chosen taking into consideration the particular application for the plates. In one embodiment of the invention the large protrusions are approximately three times the width of the other small protrusions and can also be approximately one and one half times the height of the smaller protrusions. As mentioned, the small protrusions serve as holding means for the gap-filling members positioned on the plate.

These small protrusions, which can be formed, as can the large protrusions, as tabs bent up out of the plate are, in one embodiment, disposed in a row behind each other, wherein they can additionally be configured such that the flat sides of all of the small plate-like protrusions lie in a row in one plane. This is very advantageous for attaching edge supports having a groove on their lower side into which the small protrusions can engage. However, this orientation of the plate-shaped protrusions is also advantageous when the small protrusions solely engage on the side surfaces of the gap-filling members.

The separation between two neighbouring rows of small protrusions is arbitrary. However, double rows having differing separations between the rows can be provided for on the plate. For example, the separation between the rows of a double row can be twice that or three times that of the separation of another double row provided for on the plate. The configuration can thereby be chosen in such a fashion that the separation of one row from another located on one side is different than a separation with respect to one neighbouring the other side.

Finally, the invention should not be limited to holding means configured only as protrusions. For corresponding configuration of the gap-filling members, protrusions on the gap-filling members can also engage into openings in the seating plate to replace the small protrusions. In addition, openings are also provided for in the seating plate into which bolts for the gap filling members can also engage. In this manner, the gap filling members can be more securely fixed to the seating plate.

Additional features of the invention can be extracted from the subsequent description of an embodiment of the invention in connection with the claims and the drawing. The individual features can be utilized individually or collectively in embodiments of the invention in arbitrary combination.

DESCRIPTION OF THE PREFERRED EMBODIMENT

Figure 1:
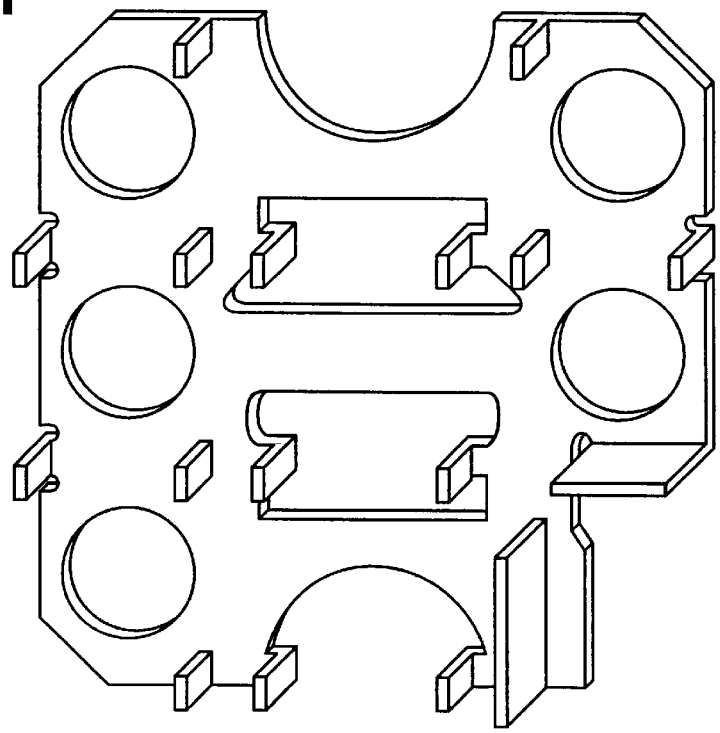
FIG. 1 shows a three-dimensional plan view of a surface of an embodiment of the plate in accordance with the invention.

In the embodiment of the invention shown in the drawing, a support structure (not shown in the figure) is provided for on the lower side of a plate 1 which extends into a longitudinal member with which it can be attached to the upper end of a hollow support. The plate 1 has circular openings 2 to reduce its weight, edge cut-outs 3 and two central cut-outs 4. Tabs 6 and 7 are bent up from the plate 1 at the left edge 5 thereof as shown in FIG. 1 to extend in the upward direction perpendicular to the surface of the plate. A tab 9 is, similar to the tabs 6 and 7, bent up at the right edge 8 as shown in FIG. 1. The tab 9 is parallel to tab 6. The tabs 10 and 11 are bent up from the edges of cut-out 4 in the row defined by the tabs 6 and 9 and are likewise parallel to the tabs 6 and 9. Tabs 13 and 14 are bent up parallel to tab 7 on the edges of the other central cut-out 14. On the lower edge of the plate 1 as shown in FIG. 1, tabs 15 and 23 are bent upwardly from the edge of the edge cut-out 3 which are parallel to each other and have the same size as the above mentioned tabs 6, 7, 9 through 11, 13 and 14. Platelike protrusions 17 and 18 are disposed on the plate parallel to and within the row formed by the tabs 6, 10, 11 and 9 which are either welded to the upper surface of the plate or are formed by upwardly protruding portions of the lower construction penetrating through slots in the plate 1. These protrusions 17 and 18 have the same size as the other tabs in this row. A plate-like protrusion 44 is located in the row formed by tabs 7, 13 and 14 and plate-like protrusion 19 is disposed on the plate 1 in the row defined by the tabs 23 and 15. Plate-like protrusions 20 and 21 are disposed at the upper edge as shown in FIG. 1. The tabs and protrusions mentioned up to this point all constitute holding means to hold and attach gap-filling members. The tabs 6 and 7 form a vertical row 45 in FIG. 1, wherein the flat portions of the tabs 6 and 7 lie in a plane. The protrusions 20, 17, 44 and 19 form a vertical row 22, wherein the flat portions of these protrusions also lie in a common plane. The upwardly bent tabs 10, 13 and 23 form a vertical row 24, the tabs 11, 14 and 15 a row 25 and the protrusions 21 and 18 a row 26. The above mentioned tabs and protrusions protrude with approximately the same areal dimensions from the upper surface of the plate 1.

The first large protrusion 28 is bent in the upward direction in the region of an edge cut-out 27 and is higher and wider than the above mentioned tabs and protrusions. A second large protrusion 29 extends upwardly from the lower edge shown in FIG. 1. This protrusion 29 extends approximately one and a half to two times more above the upper surface of the plate than the small tabs and is approximately three to five times as wide as the above mentioned tabs and protrusions. The upwardly bent first large protrusion 28 likewise protrudes approximately by one and a half to two times that of the small tabs and protrusions above the upper surface of the plate in the upward direction; it is approximately three to four times as wide as the above mentioned tabs. The flat portions of the protrusions 29 and the protrusions 28 are at right angles to each other. The protrusion 29 does not extend completely up to the point of intersection with the plane of the protrusion 28. The protrusion 29 can, in embodiments of the invention, also be the upper section of a strip of the lower construction which is guided through a slot in a plate 1 in the upward direction and projects beyond the upper surface of the plate.

Figure 2:
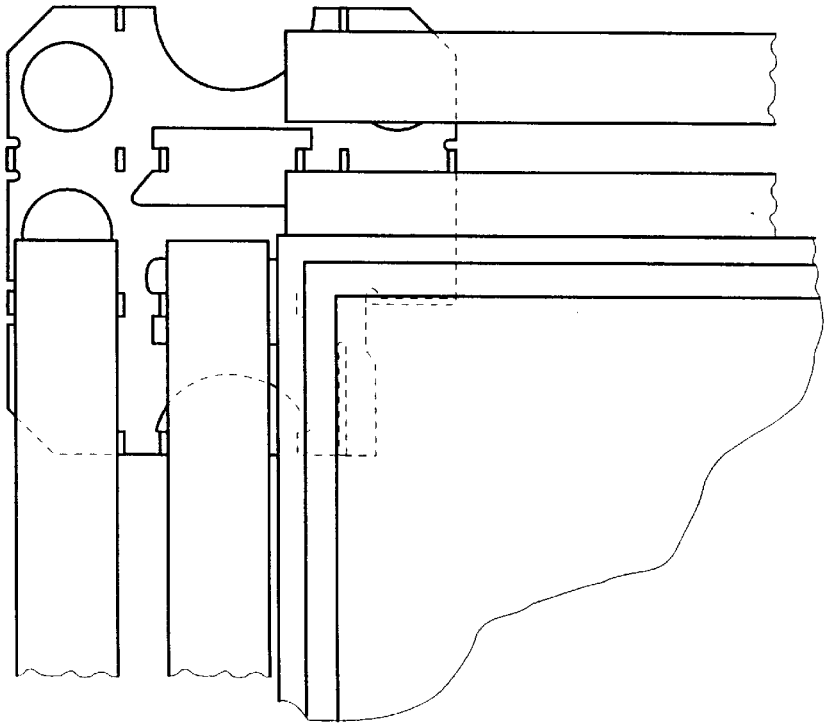
FIG. 2 shows a plan view of the plate shown in FIG. 1 having a mounted ceiling mould element and gap-filling members.

A ceiling mould element 37 of a ceiling mould has a frame made from four frame legs, two of which 30 and 31 are shown in FIG. 2, onto which a mould skin 32 is attached. The edges of the mold skin 33 and 34, in the embodiment shown in FIG. 2, protrude sidewardly beyond the frame of the ceiling mould element 37. The ceiling mould element 37 is placed on the plate 1 in such a manner that the inner surfaces 35 of the frame leg 31 which are at right angles to the mould skin 32 seat on the inner surface of the protrusion 29. The outer surface 36 of the frame leg 31, which likewise extends at right angles to the plane of the mould skin 32, then seats on the tabs 14 and 15 so that the frame leg 31 is held between the tabs 14 and 15, serving as protrusions, and the protrusion 29. The inner surface 38 of the frame leg 30 extending at right angles to the plane of the mould skin 32 seats on the inner surface of the large protrusion 28. The protrusions 14, 15 and 29 prevent a displacement of the ceiling mould element 37 at right angles to the frame leg 31 and the large protrusion 28 prevents a displacement of the ceiling mould element 37 of FIG. 2 in a downward direction. A displacement of the ceiling mould element 37 in FIG. 2 in the upward direction is prevented in that a fitting beam 39 is inserted between the sideward ends of the tabs and protrusions 11, 18 and 9 and either the edge 33 of the mould skin 32 or the outer surface 40 of the frame leg 30. This fitting beam 39 and an additional fitting beam 41 subsequently inserted on the plate 1 at the tabs 21, support a section of a plate section made of wood or from a material of the mould skin which is subsequently placed on the edge 33 onto the fitting beams 39 and 41 to extend up to the edge which the complete concrete ceiling should reach. This section of the mould skin therefore bridges the residual opening gap portion which is not easily covered by the system mould.

The ends of two fitting beams 42 and 43 can also be placed on the plate 1 in the space located in FIG. 2 at the left of frame leg 31 of the ceiling mould element 37 to support a section of the ceiling skin which bridges the intermediate space between the edge 34 of the mould skin 32 and the edge of the completed concrete ceiling.

The plate in accordance with the invention is therefore capable, with the assistance of conventional gap filling members, of bridging large gaps between the mutually perpendicular edges of a ceiling mould element and the end or edge or the end sided mould for a concrete ceiling. The edge of a ceiling element 37 is thereby firmly secured to the edge of the plate 1 and there is sufficient room on the plate 1 to still dispose two fitting beams at separations from each other on both edges of the ceiling mould element 37 upon which a plate, preferentially made from the same material as the mould skin 32, can then be securely fastened to bridge the gap between the edge of a system mould and the edge of a concrete ceiling.

The separation between the rows 45, 22, 24, 25, 26 as well as the separation between the row 26 and the edge 8 can be chosen in accordance with the reigning circumstances. For example, the separation between the edges 22 and 24 can be of the same size as the separation between the rows 25 and 26. The separation between the rows 45 and 22 can be two or three times as large as the separation between the rows 25 and 26 and the separation between the rows 24 and 25 can be three to four times as large as the separation between the rows 25 and 26. The tabs and the protrusions all have the same thickness, whereas the large protrusions 28 and 29 are higher and wider than the smaller protrusions and tabs.

The invention concerns a plate 1 of a support structure for a ceiling mould for the production of concrete ceilings, in particular seating plates of a support head with holding means disposed on the plate 1 for a ceiling mould element and for gap filling members. The invention consists essentially therein that a first large 28 and a second large 29 protrusion are provided in only one corner region of a substantially rectangular plate 1 to hold the ceiling mould element 37 which are wider and higher than a plurality of other smaller protrusions 6, 7 etc. disposed on the upper surface of the plate.

I claim:

1. A system for supporting a ceiling mould element and a gap-filling member for the production of concrete ceilings comprising:

a rectangular plate;

a single first large protrusion disposed in only one corner of said rectangular plate, said first large protrusion having a width and a height above an upper surface of said rectangular plate;

a single second large protrusion disposed in said only one corner of said rectangular plate, said second large protrusion having a width and a height above the upper surface of said rectangular plate, said second large protrusion adjacent to said first large protrusion, wherein said first and said second large protrusions cooperate for engaging and holding a corner of the ceiling mould element; and a plurality of small protrusions, said small protrusions having widths and heights above the upper surface of said rectangular plate, said small protrusion widths less than said first and said second large protrusion widths and said small protrusion heights less than said first and said second large protrusion heights.

2. The system of claim 1, wherein the ceiling mould element comprises a first and a second mutually perpendicular frame leg and an upper moulding skin mounted to said first and second frame legs, said first and second frame legs each having an inner surface extending at right angles to said moulding skin, wherein said first large protrusion abuts at said inner surface of said first frame leg and said second protrusion abuts at said inner surface of said second frame leg when the ceiling mould element is placed onto said plate.

3. The system of claim 1, wherein said small protrusions are plate-shaped.

4. The system of claim 1, wherein said small protrusions are tongues upwardly bent out of said plate.

5. The system of claim 2, wherein said first large protrusion is substantially perpendicular to said second large protrusion.

6. The system of claim 1, wherein said widths of said first and second large protrusion are at least three times said widths of said small protrusions.

7. The system of claim 1, wherein said heights of said first and said second large protrusions are at least one and a half times said heights of said small protrusions.

8. The system of claim 1, wherein said small protrusions serve for holding the gap-filling member on said plate.

9. The system of claim 1, wherein said small protrusions are disposed in rows.

10. The system of claim 9, wherein said small protrusions in one of said rows lie in a plane.

11. The system of claim 9, wherein a first separation between two neighbouring rows is at least two times a second separation between two other neighbouring rows.

12. The system of claim 11, wherein said first separation is approximately three times said second separation.

13. The system of claim 1, wherein at least one of said first large protrusion, said second large protrusion and said small protrusions consist essentially of upwardly protruding plate-shaped members of a plate support upwardly guided through slots in said plate.

14. The system of claim 1, wherein said plate has openings for mounting the gap-filling member.

* * * * *

UNITED STATES PATENT AND TRADEMARK OFFICE

CERTIFICATE OF CORRECTION

PATENT : 5,935,482

DATED : August 10, 1999

INVENTOR(S) : Artur Schwörer

It is certified that error appears in the above-identified patent and that said Letters Patent is hereby corrected as shown below:

The title page showing the illustrative figure should be deleted to be replaced with the attached title page.

In the drawings, Figs. 1 and 2, should be deleted to be replaced with the corrected Figs. 1 and 2, as shown on the attached pages.

Signed and Sealed this

Twentieth Day of June, 2000

*Attest:*

Q. TODD DICKINSON

*Attesting Officer*

*Director of Patents and Trademarks*

United States Patent [19]

Schwörer

[11] Patent Number: 5,935,482

[45] Date of Patent: Aug. 10, 1999

[54] PLATE TO SUPPORT A CEILING MOULD

[75] Inventor: Artur Schwörer, Senden, Germany

[73] Assignee: Peri GmbH, Weissenhorn, Germany

[21] Appl. No.: 09/064,142

[22] Filed: Apr. 22, 1998

[30] Foreign Application Priority Data

May 16, 1997 [DE] Germany ..... 197 20 728

[51] Int. Cl.[6] ..... E04G 11/48

[52] U.S. Cl. ..... 249/210; 249/219.1; 52/712

[58] Field of Search ..... 248/300; 52/673, 52/675, 712, 715; 249/18, 19, 218, 219.1, 28, 210

[56] References Cited

U.S. PATENT DOCUMENTS 3,785,110 1/1974 Galloway et al. ..... 52/715

FOREIGN PATENT DOCUMENTS 3024580 1/1982 Germany .
4204788 8/1993 Germany .

OTHER PUBLICATIONS

Company brochure "Peri Skydeck", p. 20, Jan. 1995.

*Primary Examiner*—Michael Safavi
*Attorney, Agent, or Firm*—Paul Vincent

[57] ABSTRACT

A plate of a support structure for a ceiling mold for the production of concrete ceilings, in particular seating plates of a support head with holding means disposed on the plate for a ceiling mold element for gap filling members. A first large protrusion and a second large protrusion are provided in only one corner region of a substantially rectangular plate to hold the ceiling mold element. The first and second large protrusions are wider and higher than a plurality of other smaller protrusions disposed on the upper surface of the plate.

14 Claims, 1 Drawing Sheet

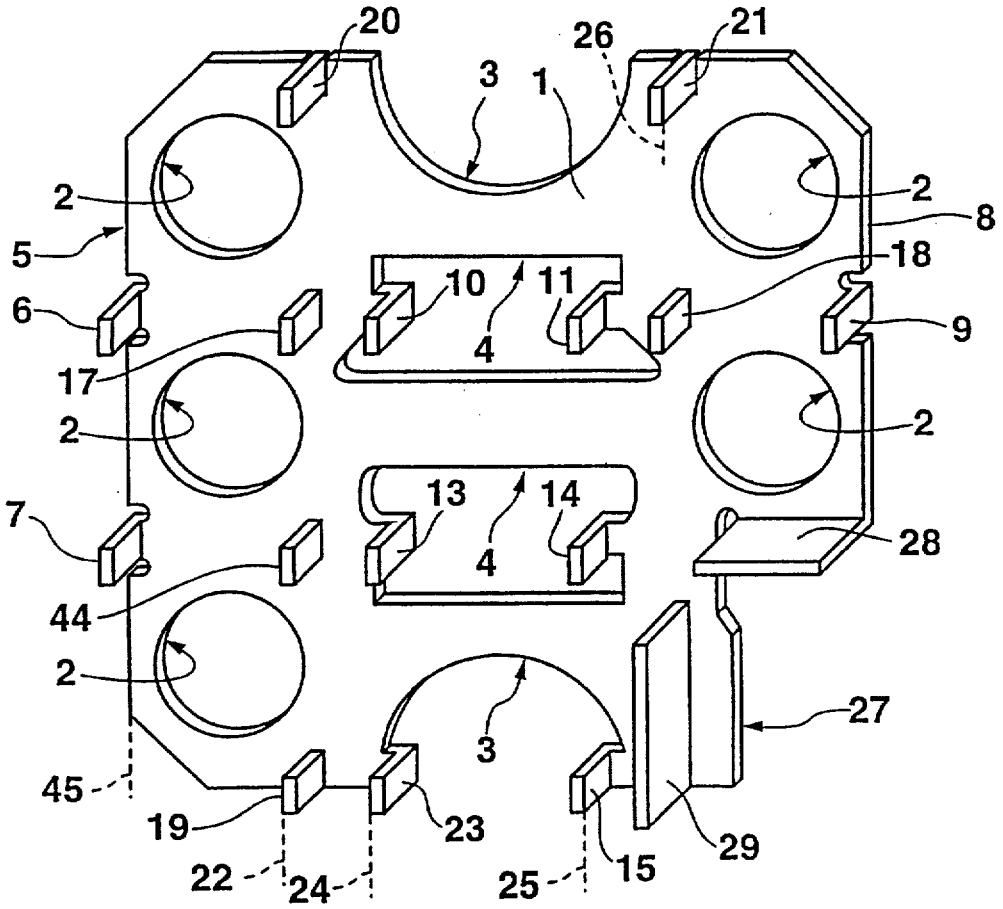

UNITED STATES PATENT AND TRADEMARK OFFICE

CERTIFICATE OF CORRECTION

PATENT NO. : 5,935,482

DATED : August 10, 1999

INVENTOR(S) : Artur Schwörer

It is certified that error appears in the above-indentified patent and that said Letters Patent is hereby corrected as shown below:

Fig. 1

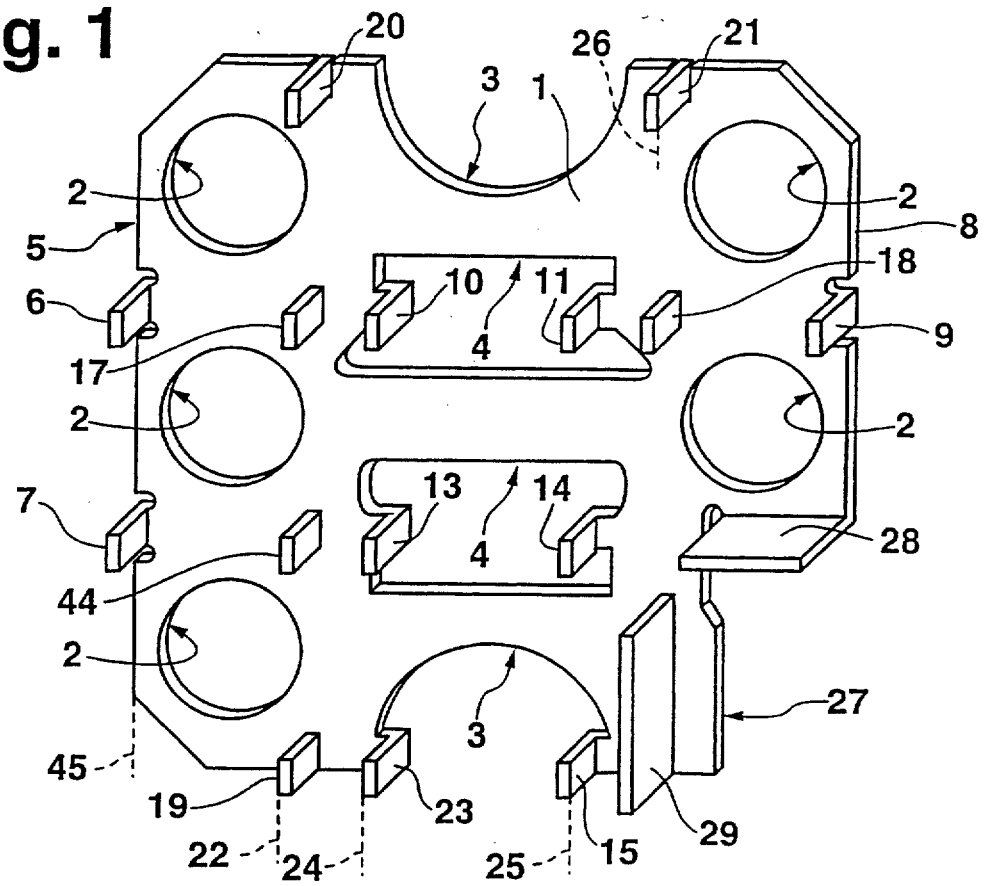

UNITED STATES PATENT AND TRADEMARK OFFICE

CERTIFICATE OF CORRECTION

PATENT NO. : 5,935,482

DATED : August 10, 1999

INVENTOR(S) : Artur Schwörer

It is certified that error appears in the above-indentified patent and that said Letters Patent is hereby corrected as shown below:

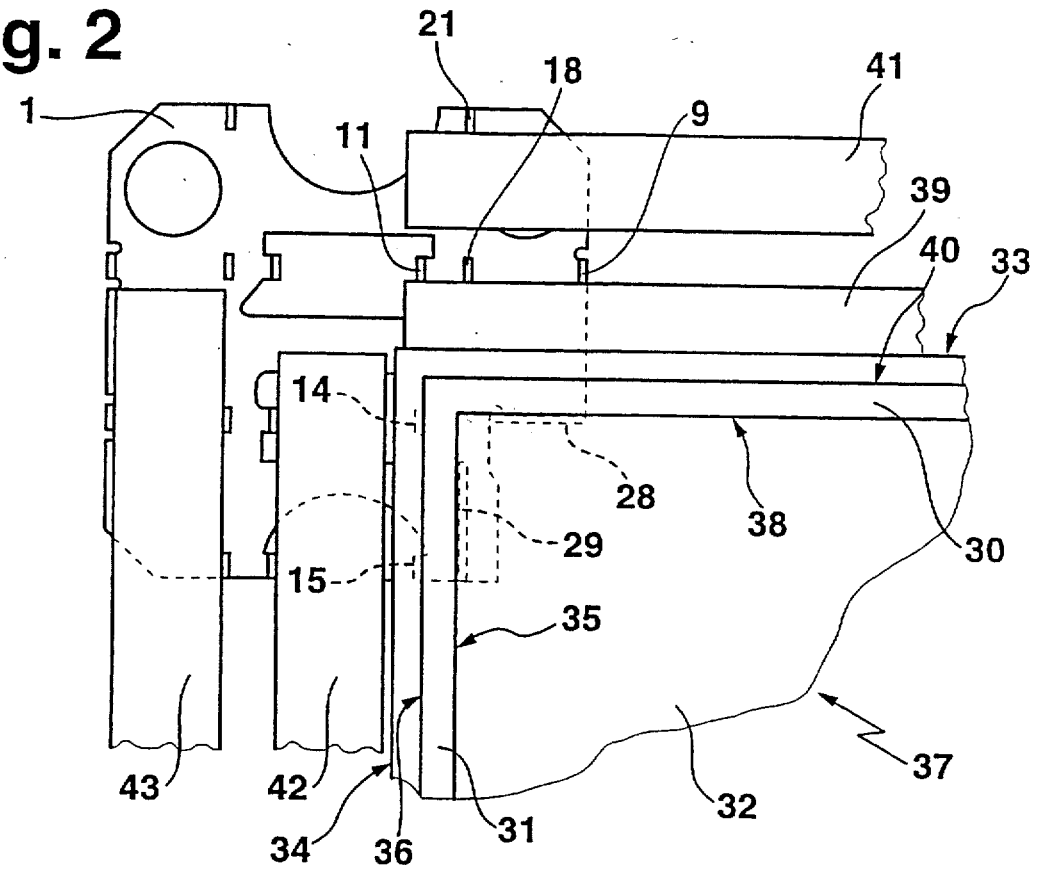

Fig. 2